United States Patent [19]

Wasson

[11] 4,437,982

[45] Mar. 20, 1984

[54] SEPARATION OF CLAY FROM COAL

[75] Inventor: George E. Wasson, Eighty Four, Pa.

[73] Assignee: Conoco Inc., Wilmington, Del.

[21] Appl. No.: 406,151

[22] Filed: Aug. 9, 1982

[51] Int. Cl.[3] ..... B03B 1/00

[52] U.S. Cl. ..... 209/5; 209/9; 209/171; 209/167; 209/17; 209/269; 209/273; 210/290; 210/269; 44/51

[58] Field of Search ..... 209/2, 3, 4, 5, 9, 10, 209/13, 17, 166, 167, 171, 273, 269; 210/307, 308, 783, 772, 269, 273, 290, 263, 792, 807; 44/51; 208/8 R, 8 LE

[56] References Cited

U.S. PATENT DOCUMENTS

| | | | |
|---|---|---|---|
| 1,063,296 | 6/1913 | Simon | 209/10 |
| 2,769,547 | 11/1956 | Hirsch | 210/290 |
| 3,043,426 | 7/1962 | Noone . | |
| 4,033,729 | 7/1977 | Capes et al. . | |
| 4,089,776 | 5/1978 | McMurray | 209/5 |
| 4,186,887 | 2/1980 | Keller, Jr. et al. . | |
| 4,248,697 | 2/1981 | Halvorsen . | |
| 4,311,488 | 1/1982 | Verschuar | 209/5 |
| 4,326,855 | 4/1982 | Cottell | 209/5 |

FOREIGN PATENT DOCUMENTS

| | | | |
|---|---|---|---|
| 1037444 | 9/1953 | France | 209/307 |

*Primary Examiner*—Bernard Nozick

*Attorney, Agent, or Firm*—Dale Lovercheck; William A. Mikesell, Jr.

[57] ABSTRACT

A method of separating fine coal particles from refuse particles comprising the step of:

(a) providing a coal filter cake (b) forming a slurry of fine coal particles, refuse particles in a liquid mixture comprising water and organic liquid, (c) contacting said coal filter cake with said slurry, whereby a major portion of said water and a major portion of said refuse pass through said filter cake and a major portion of said organic liquid and a major portion of said fine coal particles pass across the top of said filter cake.

14 Claims, 2 Drawing Figures

SEPARATION OF CLAY FROM COAL

BACKGROUND OF THE INVENTION

Noone U.S. Pat. No. 3,043,426 discloses black water clarificatiion using a refuse filter which may be any conventional suitable filter preferably a drum type filter. The refuse collecting on the filter having an ash content of as high as 70% or more is scrapped off and discharged.

Halvorsen U.S. Pat. No. 4,248,697 discloses an oil agglomeration process wherein an oil is mixed with coal slurry which is then agglomerated and screened.

Keller, Jr. et al U.S. Pat. No. 4,186,887 discloses a process for recovering coal. The process uses a fluoro carbon agglomeration agent during milling of raw coal with water having thickener.

Capes et al U.S. Pat. No. 4,033,729 discloses a method of separating inorganic material from coal. A high portion of inorganic materials content is removed from coal by providing the coal as a suspension with a liquid hydrocarbon oil, mixing an aqueous agglomerating liquid comprising water with the suspension and subsequently separating the ash from the remainder.

SUMMARY OF THE INVENTION

A method of separating fine coal particles from refuse particles comprising the step of:

(a) providing a coal filter cake (b) forming a slurry of fine coal particles, refuse particles in a liquid mixture comprising water and organic liquid, (c) contacting said coal filter cake with said slurry, whereby a major portion of said water and a major portion of said refuse pass through said filter cake and a major portion of said organic liquid and a major portion of said fine coal particles pass across the top of said filter cake.

DETAILED DESCRIPTION OF THE INVENTION

Figure 1:
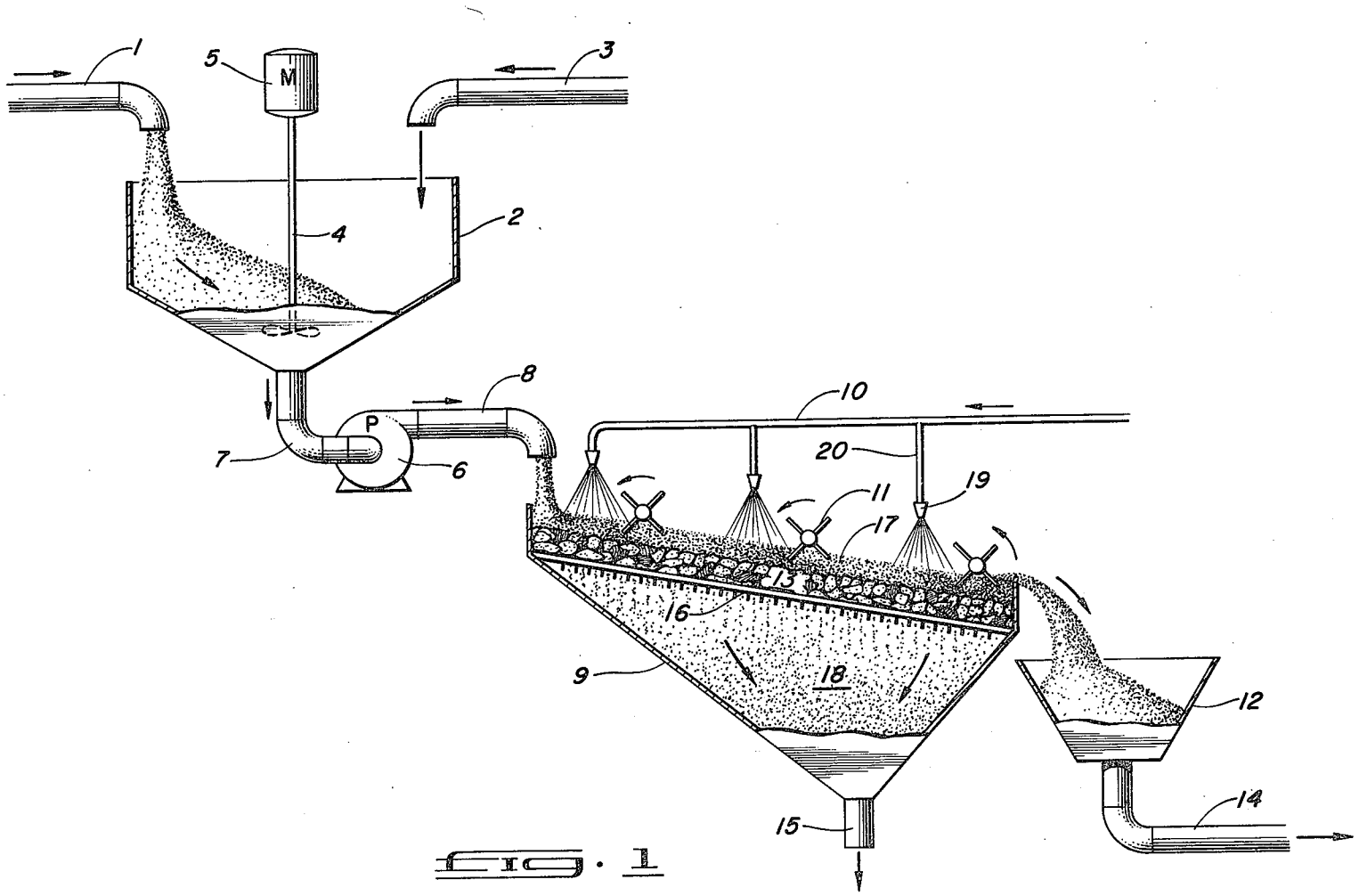
FIG. 1 shows a schematic representation of a process in accordance with the present invention using a fixed bed.

With more particular reference to the drawing wherein the same number in each Figure references the same item, it is seen in FIG. 1 that a slurry mixture of fine coal, and inorganics such as clay, refuse and water is fed through line 1 to the mixer agglomerater 2. Very vigorous mixing occurs in mixer 2. The motor 5 rotates the stirrer 4. Organic liquid is fed to the mixer agglomerater 2 through line 3. A slurry of fine coal coated with organic liquid, agglomerates, inorganics, water and organic liquid passes through line 7 to pump 6. The pump 6 pumps this slurry of agglomerates through line 8 to the filter device 9. The filter device 9 is provided with a filter cake of large coal particles 13. The filter cake 13 is supported on screen 16. The agglomerates in the agglomerate slurry are small relative to the coarse coal particles which make up the coal filter cake 13. Water and clay as well as other refuse in the agglomerate slurry passes through the coal filter cake 13 and the screen 16 into the filter device chamber 18 and pass from the filter device 9 through line 15. The coal agglomerates and organic liquid pass above the coal filter cake 13 as a layer of coal and organic liquid 17. The paddle conveyor 11 forces the coal agglomerates and organic liquid across the surface of the coal filter cake 13. The coal agglomerates and organic liquid then pass into the shoot 12. The coal agglomerates and organic liquid pass from the shoot 12 into line 14 to storage. A portion of the water passes with the coal agglomerates and organic liquid to storage. Water is sprayed over the filter device by sprayers 19. Sprayers 19 are connected by lines 20 to water feed line 10.

Figure 2:
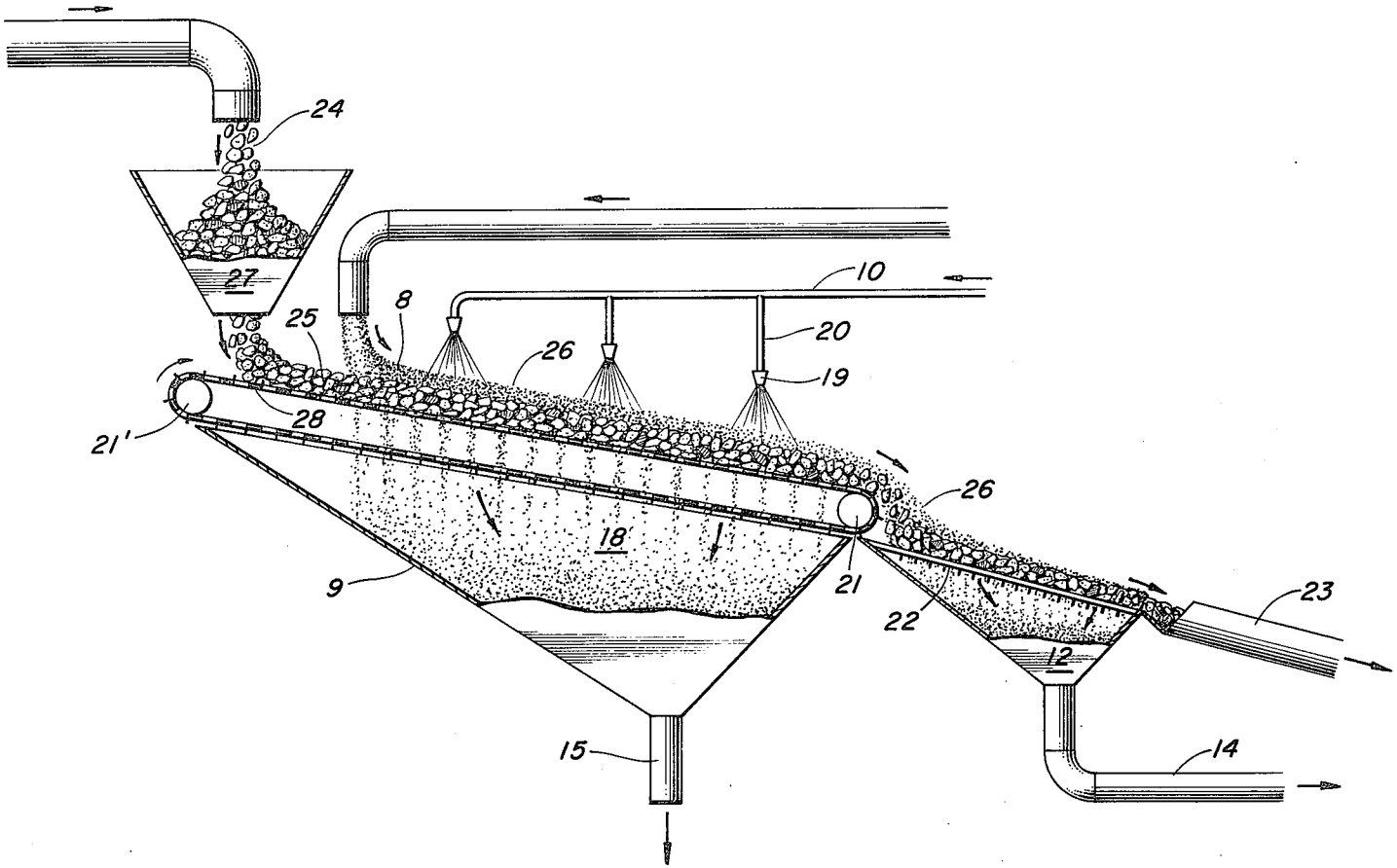
FIG. 2 shows a schematic representation of a process in accordance with the present invention using a moving bed.

With more particular reference to FIG. 2, it is seen that coarse coal 24 is fed through hopper 27. The moveable grate 28 rotates about rotary drums 21 and 21'. The coarse coal 24 forms the coal filter cake 25 as it is moved by the grate 28. The slurry of fine coal particles 8 are deposited on the upper surface of the coarse coal filter cake 25. The slurry of fine coal particles 8 includes a liquid mixture of oil and water. Refuse contained in the slurry 8 passes along with water through the coarse coal filter cake 25 across the grate 28 and into the chamber 18 of the filter device 9. The water and refuse pass through line 15 from the filter device 9. The coarse coal and the organic liquid coated fine coal particles pass along the path indicated at line 26 to the vibratory separatory screen 22. The organic liquid coated fine coal particles pass through the screen 22 into the hopper 12. The organic liquid coated fine coal particles pass from the hopper 12 through line 14. The coarse coal particles continue across the vibratory separatory screen to pass to product storage through line 23. Alternatively, the combined coarse coal and organic liquid coated fine coal at line 26 may be passed directly to product storage. The combined coarse and fine coal product may be utilized directly as a fuel.

The organic liquid coated fine coal particles form the upper portion 26 of the material being moved along the grate 28 across the separatory device 18 refuse is separated from the fine coal particles by sprays of water. Water is sprayed over the filter device by sprayers 19. Sprayers 19 are connected by lines 20 to water feedline 10. The water from sprayers 19 carries the refuse particles from the slurry containing the organic liquid coated fine coal particles in the upper portion 26 through the coarse coal portion 25 of the filter cake. The water refuse pass into the filter device chamber 18 and pass out of the filter device 18 through line 15. Thus, the filter cake having organic liquid coated fine coal particles at the upper portion thereof passing at line 26 from the rotary grate 28 is substantially separated from refuse.

On an overall basis, the fine coal which may have originated from a black water pond has refuse such as clay and other inorganics mixed therein. It is separation from this refuse that is of primary interest to the present invention. This mixture of fine coal and refuse is mixed with an organic liquid such as oil. The oil coated fine coal particles and refuse are passed over a filter cake of coarse coal which preferably is itself moving for example by means of a grate being rotated continuously around rotary drums. Sprays of water carry the refuse from the fine coal through the coarse coal and into the chamber therebelow. The organic liquid coated fine coal particles adhere to the surface of the coarse coal particles and do not pass through the coarse coal filter cake. The primary objective of separating the refuse material from the fine coal having been achieved the combination of coarse and fine coal particles may be used together or further separated and used separately.

The organic liquid used in the process of the invention is preferably a light petroleum oil. The coal fed to the agglomerater mixer is preferably fine coal from black water ponds. Preferably the black water pond fine coal is first agglomerated in the agglomerater mixer, however it is within the scope of the invention to pass the fine coal over the coal filter cake without prior oil agglomeration.

The coarse coal particles in the coal filter cake of the filter device must be larger relative to the fine coal particles being passed thereover. Preferably the coarse coal particles of the coal filter cake are at least 10 times larger in average diameter than the fine coal in the coal slurry passing thereover. Most preferably the coarse coal particles are larger than 8 Tyler mesh.

It is preferable that the coal filter cake 13 be supported by the screen 16 so that the coal slurry in line 8 descends as it passes across the upper surface of the filter cake 13. Thus, the screen 16 is preferably at an angle between 5 and 15 degrees to a horizontal line.

Preferably the organic liquid is petroleum derived and in an amount of from 2 to 8 percent by weight of the fine coal.

The use of the organic liquid in contact with the fine coal particles causes them to adhere to coal filter cake. This oil-coal filter cake adhesion allows the fine coal to be separated from the refuse.

Having thus described the invention by reference to certain of its preferred embodiments it is respectfully pointed out that embodiments described are illustrative rather than limiting in nature and that many variations and modifications are possible within the scope of the present invention. Such variations and modifications may appear obvious and desirable to those skilled in the art upon a review of the foregoing description of preferred embodiments.

Having thus described the invention, I claim:

1. A method of separating refuse from a mixture of fine coal particles and refuse particles comprising the steps of:

(a) providing a coarse coal filter cake means having an upper surface, (b) forming a solids-liquid mixture comprising a solids mixture of fine coal particles, and inorganic solid refuse particles in a liquid mixture comprising water and petroleum oil, (c) conveying said solids-liquid mixture onto said upper surface of said coarse coal filter cake to form a layer of fine coal and refuse above said coarse coal filter cake, (d) spraying water from water spray means onto said fine coal-refuse layer, whereby a major portion of said water and a major portion of said refuse pass through said coarse coal filter cake means and a major portion of said petroleum oil and a major portion of said fine coal particles remain above said filter cake means and recovering the fine coal.

2. The method of claim 1 wherein said refuse particles are primarily clay.

3. The method of claim 1 wherein said petroleum oil is petroleum in an amount of from 2 to 8 percent by weight of the weight of said fine coal particles.

4. The method of claim 1 wherein said fine coal particles are coal-oil agglomerates formed by oil agglomeration.

5. The method of claim 1 further comprising very vigorously mixing said solids liquid mixture in step (b).

6. The method of claim 1 further comprising supporting said coarse coal filter cake means on a moveable grate means.

7. The method of claim 6 wherein said grate means is a continuous grate which turns around the axis of at least two rotary drums.

8. The method of claim 1 further comprising (e) conveying said major portion of said fine coal particles and said coarse coal filter cake means beneath said water spray means.

9. The method of claim 1 wherein said coal filter cake means comprises coarse coal over a screen.

10. The method of claim 9 wherein the average size of said coarse coal is at least ten times larger than the average size of said fine coal particles.

11. The method of claim 1 further comprising conveying said major portion of fine coal particles across the top of said filter cake mean with of conveyor means.

12. The method of claim 11 wherein said conveyor means is a paddle conveyor means.

13. The method of claim 6 further comprising passing said coarse coal filter coake over a separatory screen.

14. The method of claim 13 wherein said separatory screen is a vibratory screen.

* * * * *